US010663157B2

(12) United States Patent
Nicolai et al.

(10) Patent No.: US 10,663,157 B2
(45) **Date of Patent: *May 26, 2020**

(54) LIGHTING DEVICE WITH INTEGRAL ACOUSTIC DAMPENING

(71) Applicant: Apogee Lighting Holdings, LLC, Tampa, FL (US)

(72) Inventors: Richard Nicolai, St. James, NY (US); Martin Gaon, Merrick, NY (US)

(73) Assignee: APOGEE LIGHTING HOLDINGS, LLC, Tampa, FL (US)

( * ) Notice: Subject to any disclaimer, the term of this patent is extended or adjusted under 35 U.S.C. 154(b) by 6 days.

This patent is subject to a terminal disclaimer.

(21) Appl. No.: 16/113,413

(22) Filed: Aug. 27, 2018

(65) Prior Publication Data

US 2018/0363865 A1 Dec. 20, 2018

Related U.S. Application Data

(63) Continuation of application No. 15/358,832, filed on Nov. 22, 2016, now Pat. No. 10,077,877.

(51) Int. Cl.

| | |
|---|---|
| ***H04R 1/02*** | (2006.01) |
| ***F21V 29/70*** | (2015.01) |
| ***F21V 29/89*** | (2015.01) |
| ***F21V 33/00*** | (2006.01) |
| *F21Y 115/10* | (2016.01) |
| *G10K 11/16* | (2006.01) |
| *F21V 23/02* | (2006.01) |
| *E04B 9/00* | (2006.01) |

(52) U.S. Cl.

CPC ..... *F21V 29/70* (2015.01); *F21V 29/89* (2015.01); *F21V 33/006* (2013.01); *E04B 9/001* (2013.01); *F21V 23/023* (2013.01); *F21V 23/026* (2013.01); *F21Y 2115/10* (2016.08); *G10K 11/16* (2013.01)

(58) Field of Classification Search

CPC ..... F21S 8/043; F21S 8/026; F21V 23/005

See application file for complete search history.

(56) References Cited

U.S. PATENT DOCUMENTS

| | | | | |
|---|---|---|---|---|
| 8,536,772 | B2 * | 9/2013 | Kim | H01L 51/5203 313/153 |
| 9,772,655 | B1 * | 9/2017 | Brooks | F21K 9/60 |
| 9,803,815 | B2 * | 10/2017 | Cousin | E04B 9/0478 |
| 2008/0037284 | A1 * | 2/2008 | Rudisill | F21S 2/005 362/629 |
| 2008/0278950 | A1 * | 11/2008 | Pickard | F21S 8/02 362/294 |
| 2009/0237958 | A1 * | 9/2009 | Kim | F21S 8/026 362/617 |
| 2011/0285314 | A1 * | 11/2011 | Carney | E04B 9/006 315/294 |

(Continued)

FOREIGN PATENT DOCUMENTS

| | | | | |
|---|---|---|---|---|
| WO | WO-2013057610 | A1 * | 4/2013 | G10K 11/172 |

*Primary Examiner* — Anabel Ton

(74) *Attorney, Agent, or Firm* — Tutunjian & Bitetto, P.C.

(57) ABSTRACT

A lighting fixture includes a surround formed to receive a tile therein, the surround having an outward facing side. The surround includes tabs that permit suspension of the surround in a ceiling grid. A light emitting diode (LED) is mounted on the outward facing side of the surround. A driver is connected to the LED to provide power to the LED for directing light from the outward facing side.

19 Claims, 7 Drawing Sheets

(56) References Cited

U.S. PATENT DOCUMENTS

| | | | | |
|---|---|---|---|---|
| 2012/0257384 | A1* | 10/2012 | Pickard | F21S 8/02 362/235 |
| 2013/0148357 | A1* | 6/2013 | Johnston | E04B 9/32 362/253 |
| 2014/0226316 | A1* | 8/2014 | Medendorp, Jr. | F21S 8/043 362/147 |
| 2015/0138776 | A1* | 5/2015 | Lay | F21V 25/12 362/294 |
| 2016/0018092 | A1* | 1/2016 | Knaapen | F21S 2/005 362/235 |
| 2016/0178145 | A1* | 6/2016 | Oleske | F21V 21/04 52/28 |

* cited by examiner

LIGHTING DEVICE WITH INTEGRAL ACOUSTIC DAMPENING

BACKGROUND

Technical Field

The present invention relates to light fixtures with integrated tiles, and more particularly to light emitting diode fixtures configured on or in acoustic tiles for easy maintenance and efficient use.

Description of the Related Art

Existing linear fluorescent lighting fixtures utilize tube lamping in conjunction with a ballast and reflector to provide a lighting solution. Omnidirectional light output from a linear fluorescent light source is either directly or indirectly projected from the fixture in conjunction with some form of reflecting system or lens. Typical fluorescent tubes are terminated with either a single pin or multiple pins which are fit into sockets which are wired to a ballast. Fluorescent light tubes contain mercury and must be discarded using an environmentally sound method.

Linear fluorescent lighting fixtures are employed in drop ceilings and can take up one or more grid spaces in the ceiling. These fixtures include time-consuming installation. The fixtures themselves do not include sound dampening. Light fixtures, e.g., fluorescent lights, are mounted within a ceiling grid and acoustic tiles are placed in grid spaces surrounding the light fixtures.

SUMMARY

In accordance with the present embodiments, a lighting fixture includes a surround formed to receive a tile therein, the surround having an outward facing side. The surround includes tabs that permit suspension of the surround feature in a ceiling grid. A light emitting diode (LED) is mounted on the outward facing side of the surround. A driver is connected to the LED to provide power to the LED for directing light from the outward facing side.

Another lighting fixture includes a surround including a conductive structure with openings formed therein and configured to fit and be secured within a ceiling grid, the surround having an outward facing side. A tile is insertable within the surround and is secured by tabs of the surround. One or more light emitting diodes (LEDs) are mounted on the outward facing side of the surround. A driver is connected to the LED to provide power to the LED for directing light from the outward facing side.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

Figure 1:
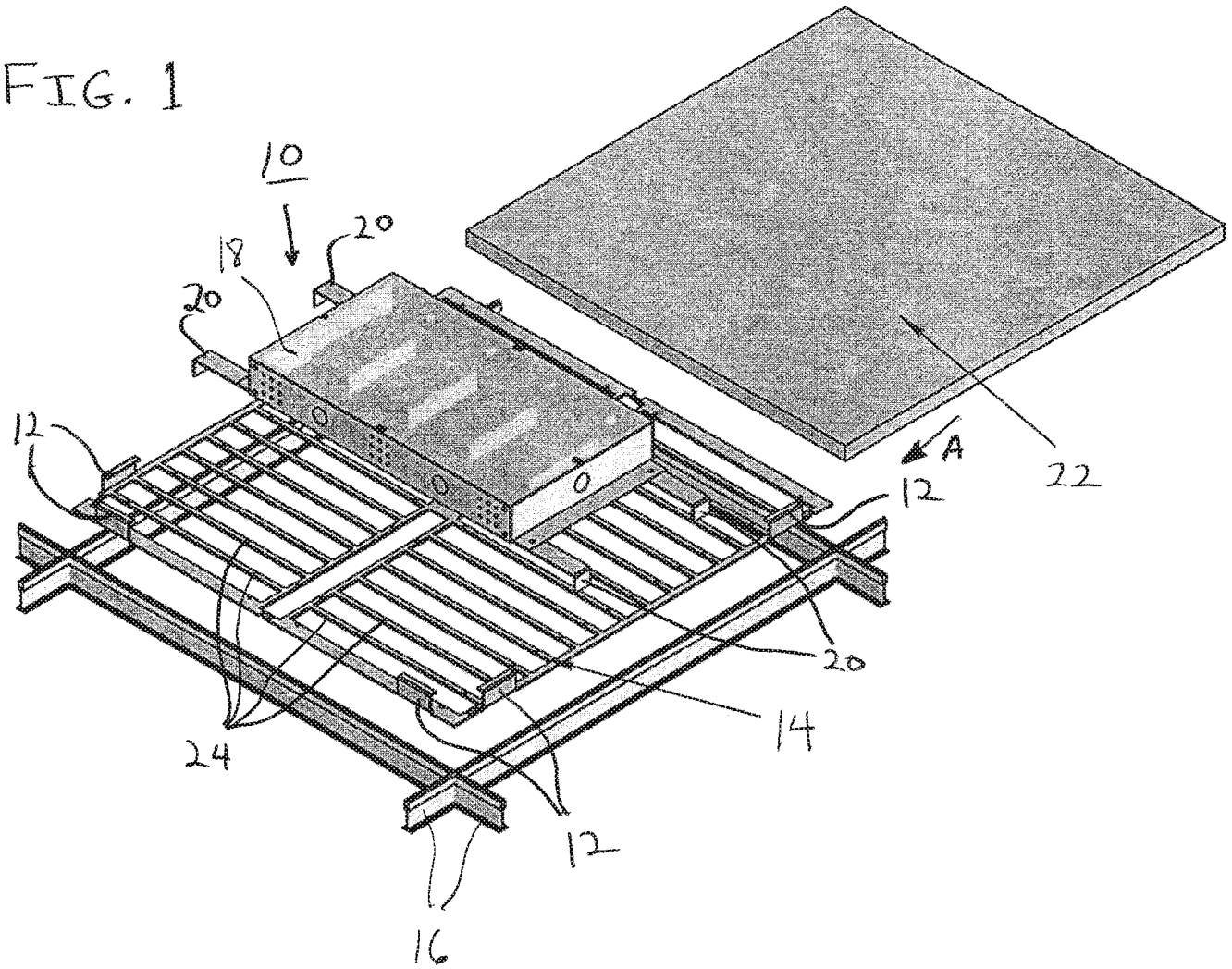
FIG. 1 is a perspective view of a lighting device or fixture showing a surround, a tile and a driver box exploded for ease of viewing in accordance with one embodiment.

In accordance with the present principles, light fixtures are provided that overcome the deficiencies of the prior art. In one embodiment, a light emitting diode (LED) or array is provided within an acoustic tile to permit installation of lights and acoustic tile (or other types of tiles) concurrently. In useful embodiments, an integral system is provided that combines lighting and sound dampening. The system simplifies installation and reduces overall cost without compromising lighting performance or sound dampening.

In one embodiment, light emitting diodes (LEDs) are circuited on a printed circuit board (PCB). The PCB footprint is minimized to provide adequate electrical and thermal responses while minimizing acoustic reflections. In one embodiment, the LED PCB is mounted to a substrate or surround which acts as a heatsink and as a mounting and alignment detail. Mounted behind the substrate or mounting plate is an acoustic absorption material (e.g., acoustic tile). The light/acoustic assembly can be mounted in a T grid system (e.g., ceiling grid) for ceiling tiles for ease of installation and quick removal or maintenance purposes. Alignment tabs on the substrate (e.g., an aluminum plate) ensure secure installation to the ceiling grid as well as a perfect longitudinal and lateral alignment (of light emitting diodes and the tile) for uniform light distribution and sound dampening.

An acoustic tile LED based light fixture can replace or retrofit existing light fixtures and provide equal or better light performance, extended service life, greater reliability, ease of installation, significant energy savings and enhanced operating features (e.g., dimming, instant start, battery backup operation, etc.).

It is to be understood that the present invention will be described in terms of a given illustrative structure or architecture having illustrative circuit layouts, fixtures and designs; however, other architectures, structures, components and process features and steps may be varied within the scope of the present invention.

It will also be understood that when an element or component is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Reference in the specification to "one embodiment" or "an embodiment", as well as other variations thereof, means that a particular feature, structure, characteristic, and so forth described in connection with the embodiment is included in at least one embodiment. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This can be extended, as readily apparent by one of ordinary skill in this and related arts, for as many items listed.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Spatially relative terms, such as "beneath," "below," "lower," "above," "upper," and the like, can be used herein for ease of description to describe one element's or feature's relationship to another element(s) or feature(s) as illustrated in the FIGS. It will be understood that the spatially relative terms are intended to encompass different orientations of the device in use or operation in addition to the orientation depicted in the FIGS. For example, if the device in the FIGS. is turned over, elements described as "below" or "beneath" other elements or features would then be oriented "above" the other elements or features. Thus, the term "below" can encompass both an orientation of above and below. The device can be otherwise oriented (rotated 90 degrees or at other orientations), and the spatially relative descriptors used herein can be interpreted accordingly. In addition, it will also be understood that when a layer is referred to as being "between" two layers, it can be the only layer between the two layers, or one or more intervening layers can also be present.

It will be understood that, although the terms first, second, etc. can be used herein to describe various elements, these elements should not be limited by these terms. These terms are only used to distinguish one element from another element. Thus, a first element discussed below could be termed a second element without departing from the scope of the present concept.

Referring now to the drawings in which like numerals represent the same or similar elements and initially to FIG. 1, a perspective view of a light emitting diode (LED) light fixture 10 is shown in accordance with one embodiment. The fixture 10 includes a surround 14, which may include a number of different configurations. The surround 14 can include a metal construction that can optionally be employed as a heat sink, e.g., for heat from LED lights or a driver box 18. In one embodiment, the surround 14 includes a grid 24 on a room side exposed (e.g., facing into the room). The grid 24 may include a screen, louvres, fins, honeycomb pattern, others designs or any other functional or design element. The grid 24 or other design permits a tile 22 to be exposed to the air within a room. In this way, for an acoustic tile 22, the acoustic waves hit the tiles through the grid 24 so that sound is dampened.

The surround 14 and the grid 24 preferably include a metal such as, for example, aluminum, steel, copper, etc. or any other suitable metal or conductive material. The surround 14 and grid 24 may be painted, coated, bare metal or include any other suitable surface configuration.

The surround 14 is configured to receive the tile 22 therein. The tile 22 can include an acoustic or ceiling tile or any other tile or planar plate or board. The surround 14 includes tabs 12, which are configured to permit the tile 22 to fit within the surround and to locate the tile 22 within the surround 14.

In one embodiment, the tile 22 can slide into the surround 14 in the direction of arrow "A". The insertion side of the surround 14 may be free of tabs 12 or may include a locking mechanism or other device to secure the tile 22 therein when loaded. In other embodiments, the tile 22 can be encapsulated between split half or clam shell portions of the surround 14. In still other embodiments, the tile 22 can be employed as a substrate to which portions of the surround 14 and other components (e.g., the drive box 18) are attached or connected. Any number of tabs 12 can be employed. The tabs 12 can include vertical portions and lateral portions to secure the acoustic tile 22 in two or three dimensions. The tabs 12 can be left off the grid 24 in one direction to permit the acoustic tile 22 to fit within the grid 24.

Once assembled, the grid 24 of the surround 14, the acoustic tile 22 and the driver box 18 (optional) form an assembly that can be employed within a ceiling grid 16. The ceiling grid 16 can be a drop ceiling, T system or other grid arrangement configured to receive tiles to provide a finished ceiling or wall configuration within a room. The ceiling grid 16 can be any dimensions, standard or custom.

In accordance with one embodiment, the fixture 10 can be employed to substitute for a conventional ceiling light fixture. By including the tile 22, the fixture 10 provides a consistent appearance without having to customize locations for light fixtures within a ceiling grid 16. The fixture 10 can fit with a single grid element (although addition grid spaces may be employed as well) of the ceiling grid 16 and include the tile 22 to provide a consistent and uniform look. Further, the inclusion of the tile 22 permits uniform insulation characteristics for both heat and sound.

A mounting bridge 20 is provided on the driver box 18 to permit the driver box 18 to be mounted on the surround 14, on the tile 22, or to both. In another embodiment, the mounting bridge 20 may be mounted on the ceiling grid 16. The mounting bridge 20 may be employed to carry power to one or more lighting elements in the grid 24 of the surround 14. In one embodiment, the power leads are carried through the tile 22. In other embodiments, the power leads are routed around the tile 22. The driver box 18 may be employed to power a plurality of LEDs in a plurality of tiles.

In one embodiment, the tile 22 can include an acoustic tile and may have alternative sizes and shapes to match the mounting conditions and architectural layout. In one embodiment, the tabs 12 may be made adjustable to accommodate different tiles, sizes or styles. In still other embodiments, the tile 22 may be customized (cut) to fit the surround 14. The surround 14 is configured to locate and center both the tile 22 and the LEDs on the surround 14.

Figure 2:
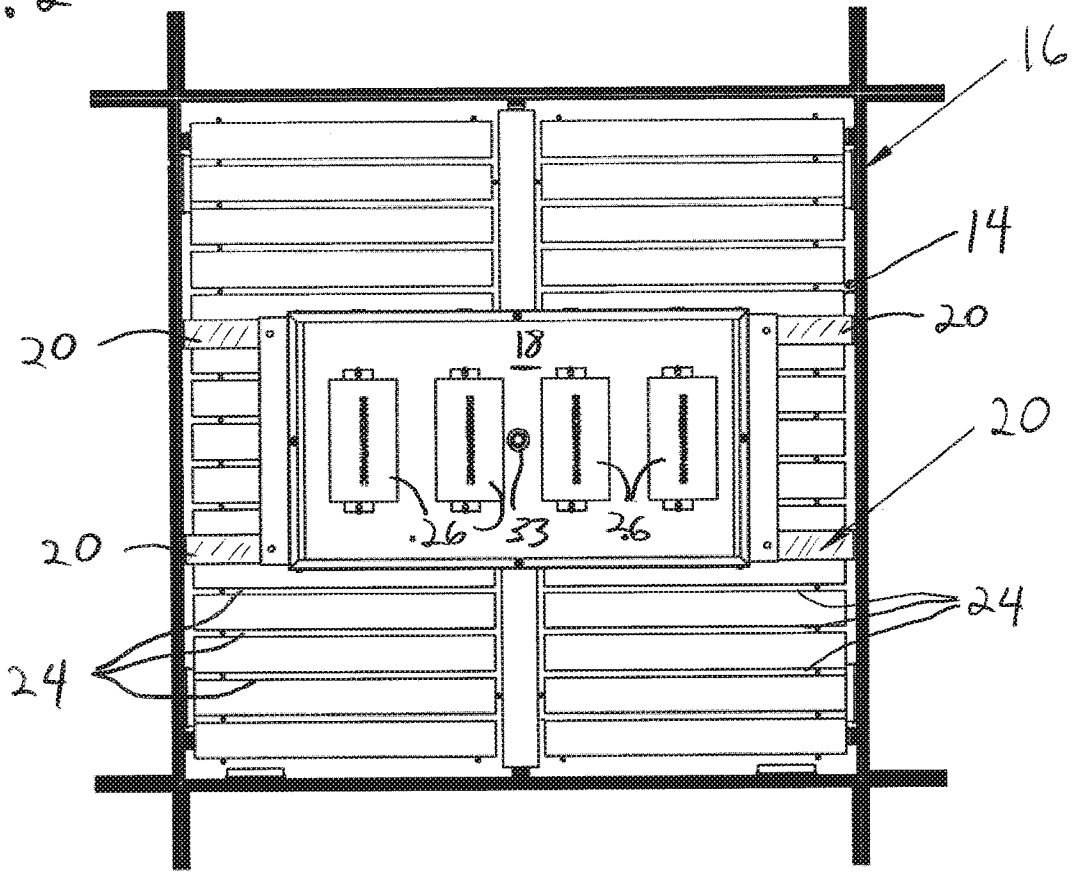
FIG. 2 is a top view of the fixture of FIG. 1 in an assembled configuration in a ceiling grid with a top cover of a driver box removed to show components of the driver box in accordance with one embodiment.

Referring to FIG. 2, a top view of the fixture 10 is shown in accordance with one illustrative embodiment without a tile 22 within the surround 14. Fixture 10 is shown installed within the ceiling grid 16. The surround 14 includes tabs 12 that interact with the ceiling grid 16 (see e.g., FIG. 5) to ensure that the surround 14 is secured within the ceiling grid 16. A cover of the driver box 18 is removed to reveal. e.g., four rectifier/transformer components 26. Other numbers and types of components 26 can be employed. The components 26 may be connected to the power grid or receive power from another circuit depending on the embodiment. The driver box 18 converts/regulates the power to provide an appropriate energy source for LED lights. A through hole 33 can be provided to directly wire the LED to be provided on the surround 14 (see FIG. 3). Other wiring elements and schemes are also contemplated.

Figure 3:
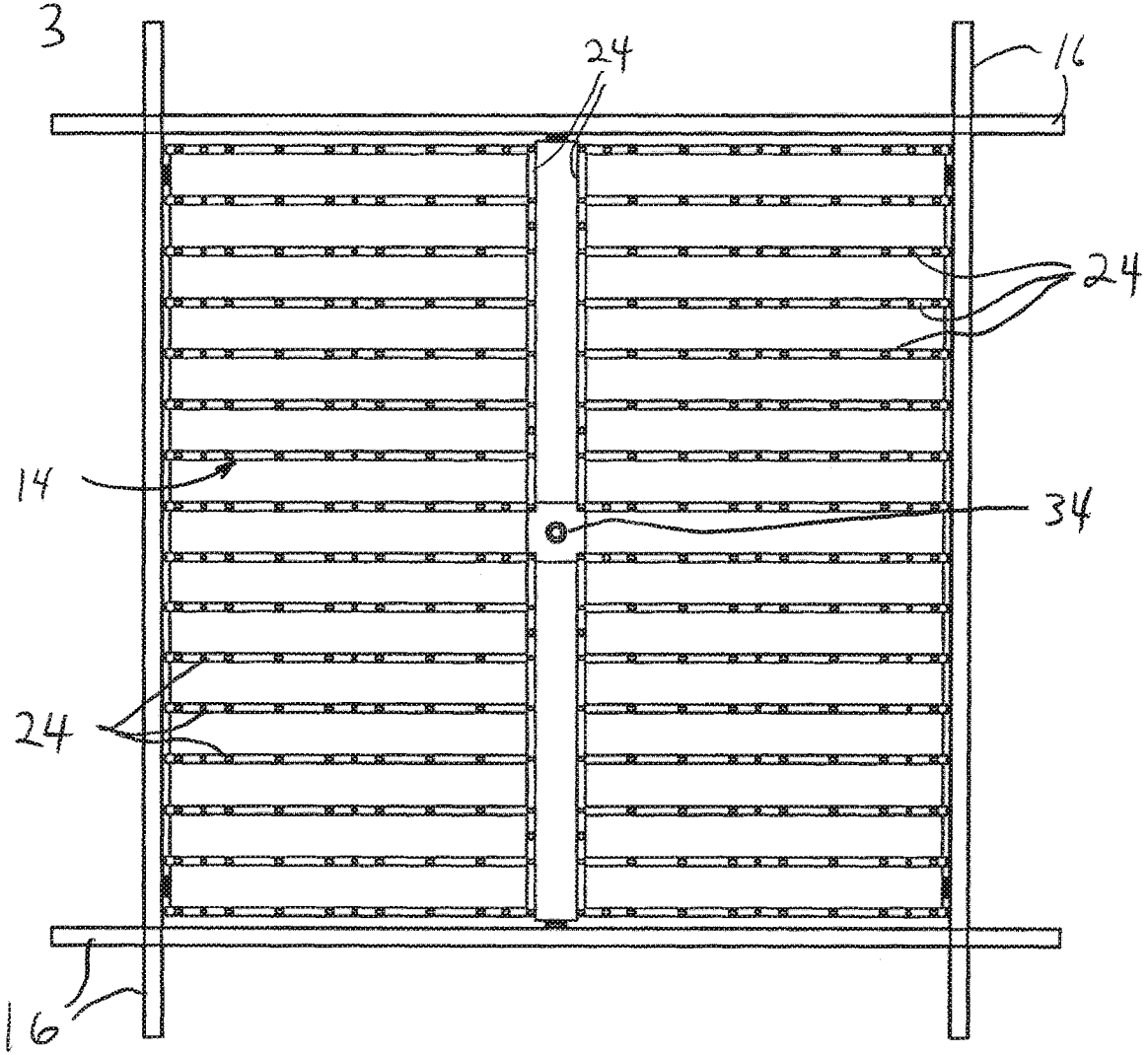
FIG. 3 is a bottom view of the fixture of FIG. 1 in an assembled configuration in a ceiling grid showing a light emitting diode for illuminating a room in accordance with one embodiment.

Referring to FIG. 3, a bottom view of the fixture 10 (from the perspective with the room being lighted) is shown in accordance with one illustrative embodiment without a tile 22 within the surround 14. Fixture 10 is shown installed within the ceiling grid 16. The tabs 12 interact with the ceiling grid 16 and therefore are not shown in this view. An LED 34 is mounted through the surround 14. In this embodiment, a single LED 34 is shown mounted in a center of the surround 14 (or grid 24); however, a plurality of other configurations are contemplated. For example, in one embodiment, a plurality of LEDs may be distributed over the surround 14 in any number of distribution patterns. The LEDs may include one or more different colors and may be controlled separately. In one example, red LEDs may be lit in one mode, white in another and so on. In another embodiment, different numbers or sets of lights may be lit in one mode and a different number in another mode, etc.

The surround 14 can include other features as well. For example, a wire channel can be included for routing leads to connect to the LED 34. The wire channel can be covered by inserts or other components to conceal the leads (not shown) from view when the fixture is installed.

Figure 4:
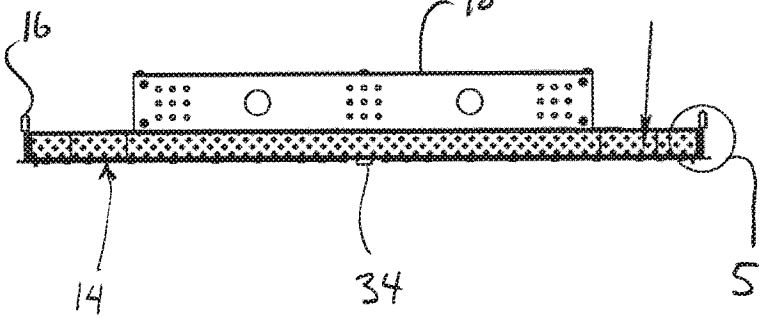
FIG. 4 is a side view of the fixture of FIG. 1 in an assembled configuration with a tile loaded therein showing a driver box on the tile and bridged across the surround in accordance with one embodiment.

Referring to FIG. 4, a side view of the fixture 10 having a tile 22 loaded within the surround 14 is illustratively shown. The ceiling grid 16 is engaged at end portions the surround 14. It should be understood that the ceiling grid 16 is depicted to show an interaction with the fixture 10 during deployment and that the ceiling grid 16 is not part of the fixture 10. The driver box 18 is disposed over the tile 22. It should be understood that not every fixture 10 needs to have a driver box 18 and that the driver box 18 can be employed for multiple LEDs 34 with multiple different tiles 22. In one embodiment, the driver box 18 serves four tiles 22. Detail 5 is shown in greater detail in FIG. 5.

Figure 5:
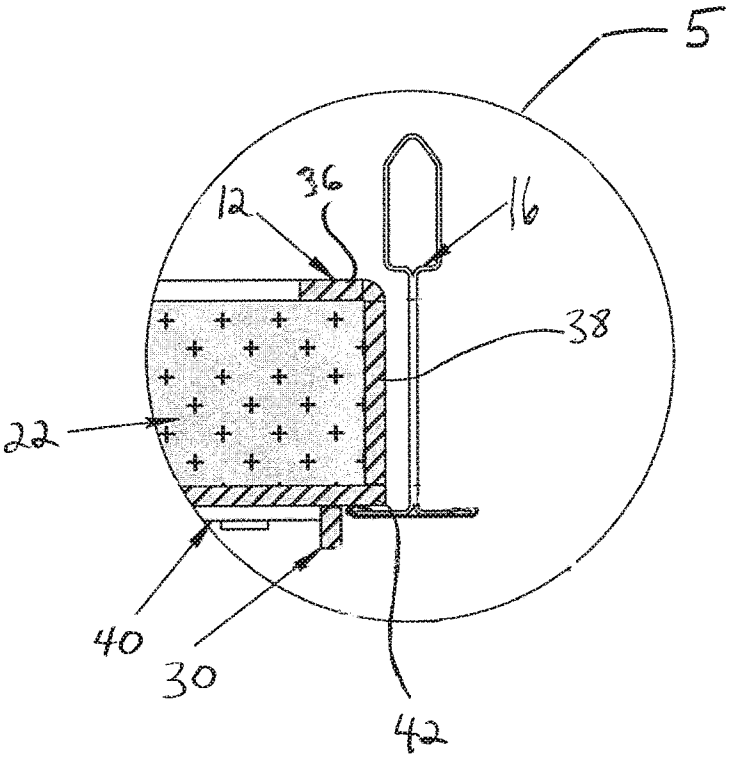
FIG. 5 is a magnified view of detail 5 of FIG. 4 showing the tile and a lighting emitting diode board secured within the surround in accordance with one embodiment.

Referring to FIG. 5, detail 5 of FIG. 4 is shown in greater detail. Detail 5 shows a tile 22 fit within a tab 12 of the surround 14. The tabs 12 secure the tile 22 from movement in three dimensions. The tab 12 includes a vertical portion 38 that interfaces with side(s) of the tile 22. The surround 14 and top portion 36 interface with a top and bottom of the tile 22. Corners 42 of the surround 14 provide an interference fit with the ceiling grid 16 to permit suspension of the fixture 10 in the ceiling grid 16.

The surround 14 can include other features as well. For example, in one embodiment, the surround 14 includes an alignment tab 30. The alignment tab 30 can be employed to support and position an LED printed wiring board 40 or other facade of plate that connects to the surround 14 on the room side of the fixture 10. The alignment tab or tabs 30 may be fixed or may include an adjustment capability.

Figure 6:
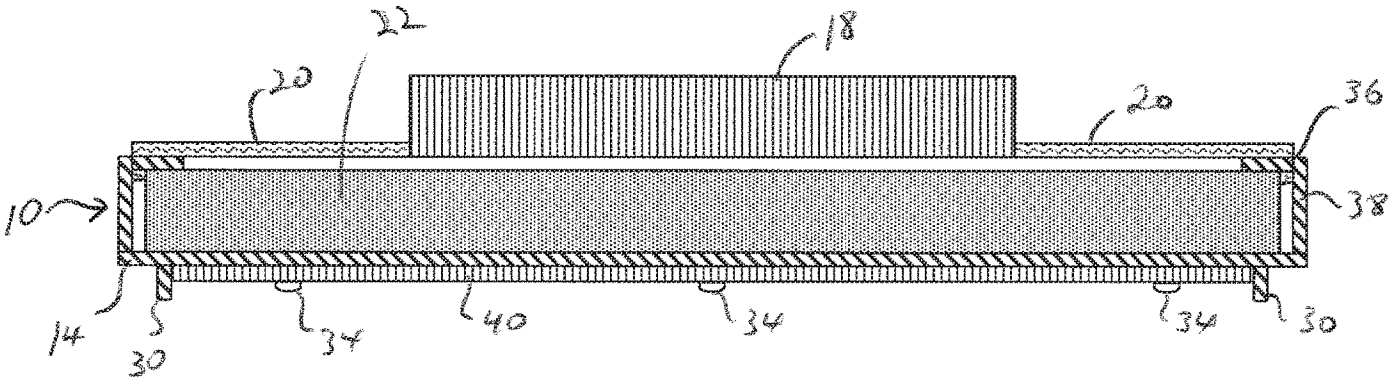
FIG. 6 is a cross-sectional view showing an assembled light fixture in accordance with an illustrative embodiment.

Referring to FIG. 6, a cross-sectional view of the fixture 10 having a tile 22 loaded therein is shown in accordance with an illustrative embodiment. The driver box 18 is included but need not be for all tiles/fixtures. The driver box 18 and bridge 20 are depicted with a gap between the driver box 18 and the tile 22 for clarity. The driver box 18 may sit flush on the tile 22. An LED board or panel 40 is fit between the alignment tabs 30. The LED board 40 may be secured to the surround 14 by screws, clips, rivets, adhesive, or any other way of attaching the LED board to the structure 14. The LED board is preferably detachable to permit easy change out in case of a failure or upgrade. In other embodiments, the LEDs 34 may be provided directly on or in the surround 14 without the use of the board or panel 40. In the embodiment shown, three LEDs 34 are depicted. However, any number of LEDs 34 may be employed.

Figure 7:
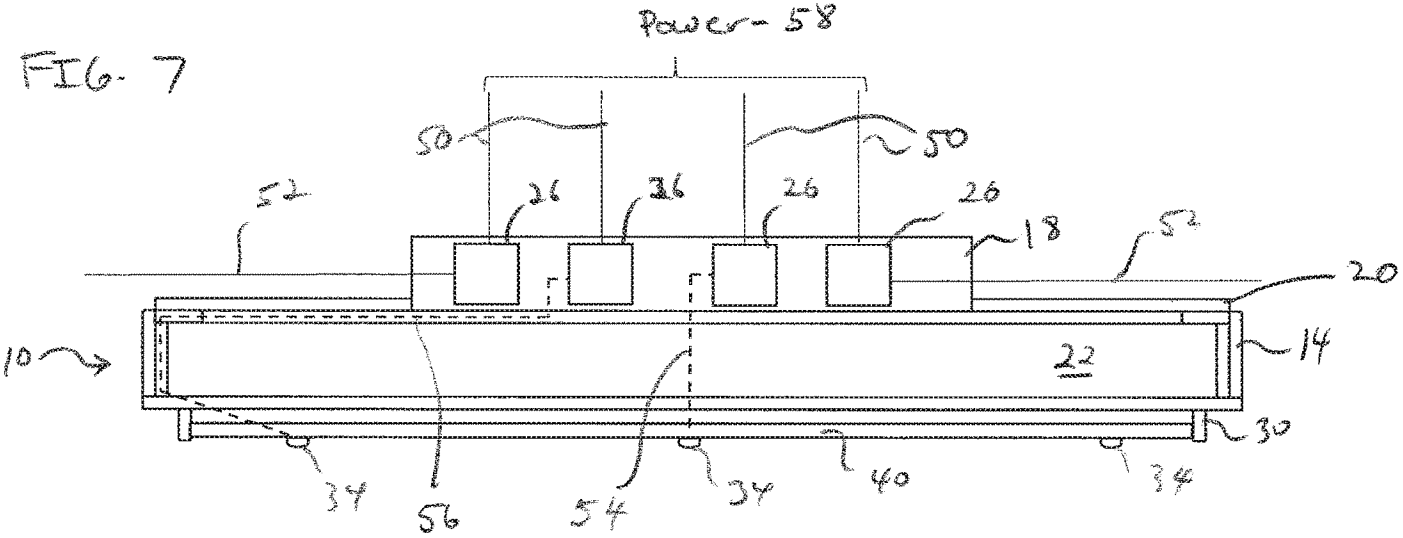
FIG. 7 is a cross-sectional view showing an assembled light fixture with possible wiring routes from a driver box to light emitting diodes or a light emitting diode board in accordance with illustrative embodiments.

Referring to FIG. 7, an illustrative diagram shows possible wiring schemes in accordance with illustrative embodiments. In this example, the driver box 18 is included but need not be for all tiles/fixtures. The driver box 18 and bridge 20 are depicted with a gap between the driver box 18 and the tile 22 for clarity. The driver box 18 may sit flush on the tile 22. The LED board or panel 40 is fit between the alignment tabs 30.

The driver box 18 includes components 26, which may include rectifiers, transformers and other devices for conditioning input power 58 on input power lines 50. Input power 58 may include AC house voltage, DC voltage from a battery, a DC power supply or any other suitable power source. In one embodiment, the components 26 include LED driver circuits that permit an input power of between about 120-277 volts. The components 26 may include a 30 W driver for each tile 22 and permit dimming (e.g., 0-10 volts DC).

In one embodiment, the driver box 18 includes four drivers (26). One driver 26 may be employed for the fixture 10 on which the driver box 18 is mounted, and three fixtures 10 are slave fixtures that employ the other three drivers 26. The driver box 18 is preferably metal, e.g., galvanized steel, although other metals and materials may be employed.

For illustrative purposes, the components (drivers) 26 show different wire connections to the LEDs 34 or LED board 40. One path 54 goes through the tile 22 and can be wired if the tile 22 permits. Another path 56 is formed around the tile 22 and does not affect the tile in any way. Path 56 is within the surround 14 and passes to the LED 34 or the LED board 40 without interfering with the loading of the tile 22 within the fixture 10. Paths 52 show wiring paths that extend conditioned power to adjacent or nearby fixtures 10 (e.g., slave fixtures). The LEDs 34 may be provided directly on or in the surround 14 without the use of the board or panel 40. In the embodiment shown, three LEDs 34 are depicted. However, any number of LEDs 34 may be employed.

It should be understood that the driver box 18 being located on top of the surround and/or tile 22 is merely illustrative. The driver box 18 or a single driver (26) may be mounted on top of the surround 14 and/or tile 22. In another embodiment, the driver box 18 or the single driver (26) may be remotely disposed and wires or connections may be routed through the ceiling grid 16 and/or over the surround (s) 14 and/or tiles 22 to connect with LEDs 34. In still other embodiments, the driver box 18 or single drivers (26) can be connected to or attached to the ceiling grid 16 using a structure or platform configured to engage the ceiling grid 16, as needed (see FIGS. 9 and 10).

Figure 8:
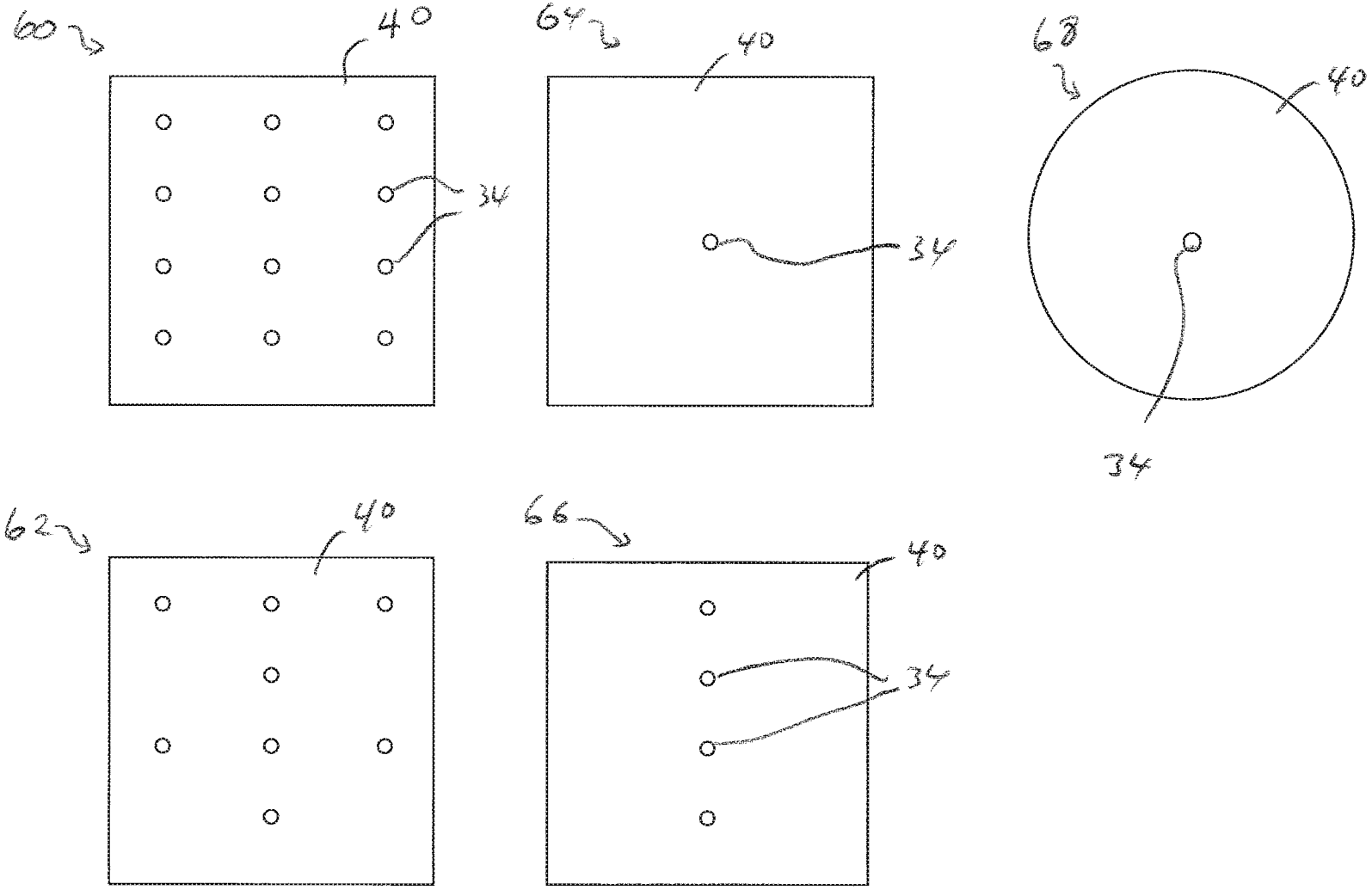
FIG. 8 is a diagram showing different illustrative light emitting diode panels in accordance with the present principles.

Referring to FIG. 8, a plurality of LED panels 60, 62, 64, 66, 68 are illustratively shown with different LED patterns. The LED panels 60, 62, 64, 66, 68 can include any shape, size, color or ornamental features. The LED panels 60, 62, 64, 66, 68 can include printed wiring boards which can have ornamental covers placed over them when installed, or the LED panels 60, 62, 64, 66, 68 can include a plate or sheet which includes LEDs 34 that pass through the panel or sheet. The LEDs 34 can be placed in any pattern. The LEDs 34 may be limited by the output power available for the drivers. In one particularly useful embodiment, the power requirements may be 5 W per square foot, for about 900 lumens per square foot output. Other input/output energies are also contemplated.

The LED panels 60, 62, 64, 66, 68 include different LED densities and arrangements. The shapes and arrangements of LEDs 34 are not limited to those shown. Any removable LED panel 60, 62, 64, 66, 68 may be employed.

It should be understood that the present embodiments may be employed anywhere LED lighting can be used. In addition, the tile may include acoustic tile for sound dampening. The fixtures described may include acoustic tiles for use in concurrently lighting and sound dampening in indoor spaces. Particularly useful embodiments can include conference room lighting and sound dampening, lobby lighting and sound dampening, gymnasium lighting, theater lighting, backlit luminous ceilings, etc.

Figure 9:
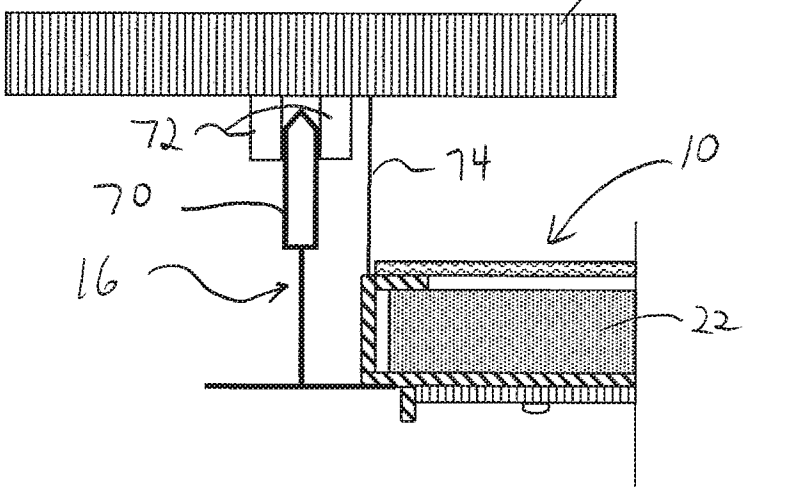
FIG. 9 is a diagram showing a cross-section of a ceiling grid rail and having a driver box/driver secured on the ceiling grid rail in accordance with the present principles.

Referring to FIG. 9, a schematic diagram shows a ceiling grid 16 in cross-section suspending a light fixture 10 in accordance with one illustrative embodiment. Here, the driver box 108 or a single driver 26 is connected to a rail 70 of the ceiling grid 16. The driver box 18/driver 26 can include a structure 72, such as clips, clamps, or other securing mechanism(s) to secure the driver box 18/driver 26 to the rail 70. A wire or wires 74 from the driver box 18/driver 26 can be connected to the fixture 10 (e.g., using quick connectors, etc.). The driver box 18/driver 26 can be employed to power several LEDs associated with tiles 22 in the area or remotely. In one embodiment, the drivers may be positioned in a wall or other area.

Figure 10:
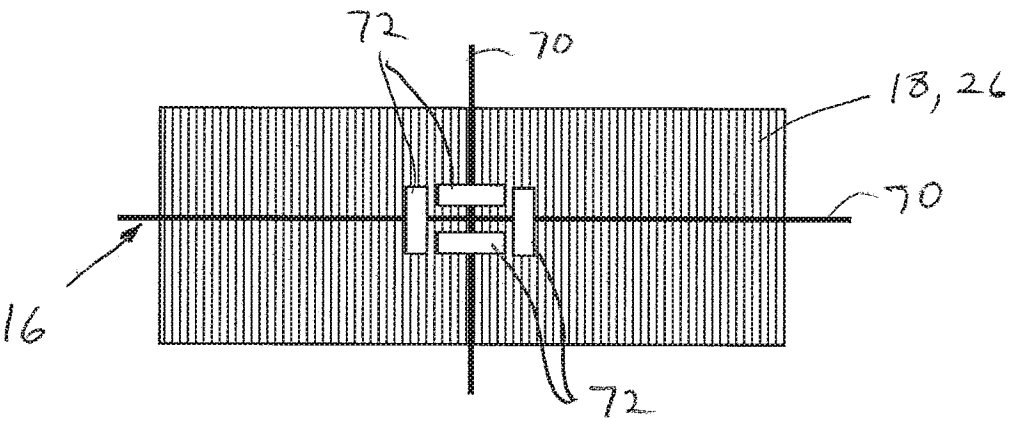
FIG. 10 is a diagram showing a bottom view of ceiling grid rails and having a driver box/driver secured on the ceiling grid rails with a securing structure in accordance with the present principles.

Referring to FIG. 10, an illustrative diagram shows a bottom view of a driver box 18/driver 26 connected to the ceiling grid 16. The structures 72 can be distributed along different segments and different directions of the grid to provide stability. The driver box 18/driver 26 should be positioned with enough clearance to ensure that the light fixtures 10 and/or tiles 22 can be properly installed in the ceiling grid 16.

Having described preferred embodiments for lighting device with integral acoustic dampening (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A lighting fixture, comprising:
a surround formed to receive an acoustic tile, the surround having tabs; and
a light emitting diode (LED) mounted on an outward facing side of the surround.

2. The lighting device as recited in claim 1, further including a driver to condition power from alternating current to direct current.

3. The lighting device as recited in claim 1, wherein the light emitting diode is formed on a panel.

4. The lighting device as recited in claim 3, wherein the panel is removable from the surround.

5. The lighting device as recited in claim 4, wherein the surround includes alignment tabs to position the panel.

6. The lighting device as recited in claim 1, wherein the tabs position and secure the tile.

7. The lighting device as recited in claim 1, wherein the surround includes a conductive material and functions as a heat sink for the LED.

8. The lighting device as recited in claim 1, further comprising a tile secured within the surround.

9. The lighting device as recited in claim 1, wherein the lighting fixture employs the tabs to locate the surround.

10. A lighting fixture, comprising:
a surround including a conductive structure with openings formed therein, the surround including an inward facing side having tabs;
an acoustic tile insertable into the surround; and
one or more light emitting diodes (LEDs) mounted on an outward facing side of the surround.

11. The lighting device as recited in claim 10, further including a driver to condition power from alternating current to direct current.

12. The lighting device as recited in claim 10, wherein the one or more LEDs are formed on a panel.

13. The lighting device as recited in claim 12, wherein the panel is removable from the surround.

14. The lighting device as recited in claim 10, wherein the surround includes alignment tabs to position the panel.

15. The lighting device as recited in claim 10, wherein the tabs position and secure a tile.

16. The lighting device as recited in claim 10, wherein the surround functions as a heat sink for the one or more LEDs.

17. The lighting device as recited in claim 10, wherein the lighting fixture fits within a single opening in a ceiling grid.

18. The lighting device as recited in claim 10, further including a remotely disposed driver.

19. A lighting fixture, comprising:
a surround formed to receive a tile, the surround having tabs;

a light emitting diode (LED) mounted on an outward facing side of the surround; and a remotely disposed driver.

* * * * *